US007898097B1

(12) United States Patent
Fries et al.

(10) Patent No.: US 7,898,097 B1
(45) Date of Patent: Mar. 1, 2011

(54) PHASE CHANGE ON DEMAND INTEGRATED PRESSURE PUMP AND POWER PLANT

(75) Inventors: David P. Fries, St. Petersburg, FL (US); Chad Lembke, St. Petersburg, FL (US)

(73) Assignee: University of South Florida, Tampa, FL (US)

( * ) Notice: Subject to any disclaimer, the term of this patent is extended or adjusted under 35 U.S.C. 154(b) by 14 days.

(21) Appl. No.: 12/433,372

(22) Filed: Apr. 30, 2009

Related U.S. Application Data

(60) Division of application No. 11/470,854, filed on Sep. 7, 2006, now Pat. No. 7,531,908, which is a continuation-in-part of application No. 10/605,497, filed on Oct. 2, 2003, now abandoned.

(60) Provisional application No. 60/319,591, filed on Oct. 2, 2002.

(51) Int. Cl.
*F02C 5/02* (2006.01)
*F02K 9/06* (2006.01)

(52) U.S. Cl. ..... 290/1 A; 290/1 R; 60/251

(58) Field of Classification Search ..... 290/1 R, 290/1 A, 2, 43, 54; 60/251
See application file for complete search history.

(56) References Cited

U.S. PATENT DOCUMENTS 6,062,018 A * 5/2000 Bussing ..... 60/39.39
6,250,072 B1 * 6/2001 Jacobson et al. ..... 60/251
7,531,908 B2 * 5/2009 Fries et al. ..... 290/1 R

* cited by examiner

*Primary Examiner*—Nicholas Ponomarenko
(74) *Attorney, Agent, or Firm*—Jeremy Spier; Smith & Hopen, P.A.

(57) ABSTRACT

Activation of a propellant in a constant volume container causes a phase change material to rapidly expand so that the pressure in the container increases. Programmability and sequential actuation are enabled by patterning the phase change material into the integrated device. The pressure generated may be used to activate an energy transducer such as a high pressure turbine, a piezoelectric material, and an elastic strain material. This provides a hybrid actuation system of electrical energy, pneumatic and hydraulic power. The pressure change in a constant volume container is also harnessed to provide a microbattery.

1 Claim, 8 Drawing Sheets

PRIOR ART

PHASE CHANGE ON DEMAND INTEGRATED PRESSURE PUMP AND POWER PLANT

CROSS-REFERENCE TO RELATED DISCLOSURE

This disclosure is divisional application of pending U.S. patent application Ser. No. 11/470,854, filed Sep. 7, 2006, which application is a continuation in-part to U.S. nonprovisional patent application Ser. No. 10/605,497, filed Oct. 2, 2003 by the same inventors and having the same title, which is a nonprovisional to provisional patent application No. 60/319,591, filed Oct. 2, 2002 by the same inventors and having the same title.

STATEMENT OF GOVERNMENT INTEREST

The subject invention was made with government support under a research project supported by the Office of Naval Research Grant No. N00014-98-1-0848. The federal government has certain rights in this invention.

BACKGROUND OF THE INVENTION

This invention relates to a portable pressure pump and integrated power supply that relies on high pressure generated by gases released during the phase change of a phase change material in a closed, constant volume container.

Published patent application WO 00/03758 in the name of SpectRx & Altea Technolgoes of Atlanta, Ga., discloses a pyrotechnic-based method for making an opening in skin for drug delivery.

Another patent application, number unknown, in the name of Carole Rossi, a researcher affiliated with LAAS-CNRS of Toulouse, France and the University of California at Berkeley, discloses a pyrotechnic method for drug delivery.

Many mechanical, pneumatic, and hydraulic devices are operated by gaseous or liquid pressure. Moreover, electricity-generating turbines are driven by fluids under pressure as well. Gaseous fluids under pressure occupy less space than gaseous fluids that are not under pressure, but it can be problematic in some applications if gaseous fluid under pressure must be maintained in a container or other pressure vessel for extended periods of time so that the gaseous fluid may be released when it is needed to operate a device or to generate electricity. It would be advantageous if there were a way to generate gaseous fluid under pressure on demand so that holding tanks or other pressure vessels having compressed gas therein could be eliminated.

However, in view of the prior art taken as a whole at the time the present invention was made, it was not obvious to those of ordinary skill how the identified need could be fulfilled.

SUMMARY OF THE INVENTION

The long-standing but heretofore unfulfilled need for a means for generating high pressure on demand is now met by a new, useful, and non-obvious invention.

The novel method for providing an energy reservoir of compressed fluid on demand includes the steps of positioning a phase change material in a constant volume container and activating a phase change in the phase change material. The pressure in the container thus increases in accordance with the combined gas law.

A method for harnessing the energy in compressed fluid to do usable work includes the steps of providing an energy reservoir of compressed fluid on demand by activating a phase change in a phase change material positioned in a constant volume container and connecting a pressure-driven load in fluid communication with the energy reservoir of compressed fluid. The pressure-driven load may be a turbine adapted to generate electrical power, a piezo-chamber adapted to generate electrical power, a pump, or the like.

The pressure-driven load is positioned between the energy reservoir of compressed fluid and a high pressure storage tank. More particularly, the energy reservoir of compressed fluid is in fluid communication with an input of the pressure driven load and the high pressure storage tank is in fluid communication with an output of the pressure-driven load.

A pneumatic or hydraulic circuit may also be positioned in fluid communication between the energy reservoir of compressed fluid and said high pressure storage tank. A mechanical, fluidic, or other pressure-driven load may be coupled to an output of said pneumatic or hydraulic circuit.

The invention further includes a novel microbattery that includes a plurality of layers of elements that interact with one another to produce an electrical current. A plurality of propellant members, each of which is formed of a phase-change material, is mounted to one of said layers of elements. The microbattery further includes an initiator means that may take the form of a plurality of conductors, each conductor of said plurality of conductors providing electrical communication between a preselected propellant member of said plurality of propellant members and said initiator means.

Another layer provides a pressure cell that defines a closed volume for housing the plurality of propellant members. A fluidic oscillator is mounted on the pressure cell and a flexible diaphragm is mounted to the fluidic oscillator. The flexible diaphragm is adapted to oscillate as the fluid oscillator alternately directs fluid to opposite sides of the flexible diaphragm.

A magnetic core is mounted to the flexible diaphragm. A cap layer is mounted in surmounting relation to the flexible diaphragm. A coil is mounted to the cap layer and is adapted to receive the magnetic core.

A preselected propellant is activated by the initiator means, resulting in an explosion of the preselected propellant that increases pressure within the pressure cell. The pressure is harnessed to drive the fluidic oscillator and the fluidic oscillator causes flow of a preselected fluid to alternately flow to opposite sides of said flexible diaphragm so that the flexible diaphragm oscillates and thereby causes back-and-forth motion of the magnetic core relative to the coil. The relative motion between the magnetic core and the coil produces alternating current.

It is therefore understood that a primary object of the invention is to provide a portable pressure pump and an integrated power supply that relies on high pressure that is generated on demand to obviate any need for storing high pressure gases or liquids.

A more specific object is to generate usable high pressure on demand by activating a phase change material that is housed within a closed container so that the pressure within said container is increased.

Another object is to disclose a microbattery construction made possible by the use of a phase change material for producing high pressure gases on demand.

These and other objects will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

An integrated pump includes a pressure source and an integrated particulate filter. It pumps clean gas or liquid into separation systems such as chromatographic columns The material used for actuation is any material that transitions through a phase change in a confined, constant volume, resulting in a pressure increase in accordance with the combine gas law. More particularly, the material may be any reactive material such as pyrotechnic powders, plastic based explosives, binary reactant explosives/propellants, hypergolic reactant propellants, catalytic reactants, combustion reactants or other phase change material.

The phase change material may be patterned into the integrated device. Thus it is understood that the pump may be programmable for sequential actuation.

The novel pump also yields an alternative power supply technology. The pressure generated is used to activate an energy converter such as a high pressure turbine, a piezoelectric material, or an elastic strain material (such as a spring, for example) to convert the energy stored in the compressed fluid. A hybrid actuation system of electrical energy, pneumatic and hydraulic power is thereby created.

A pressure driven fluid pump and pressure driven power supply (either electrical, pneumatic or hydraulic) is reliant upon the pressure developed during a phase change of state of a preselected phase change material.

The phase change is an explosion within a constrained vessel creating a desired high pressure that provides the motive force for fluid transfer, actuation and stored energy for subsequent energy conversion. Significantly, the high pressure is not generated until it is needed, thereby eliminating the prior art need to have gases or liquids maintained in pressure vessels over long periods of time until such pressure is needed.

Figure 1:
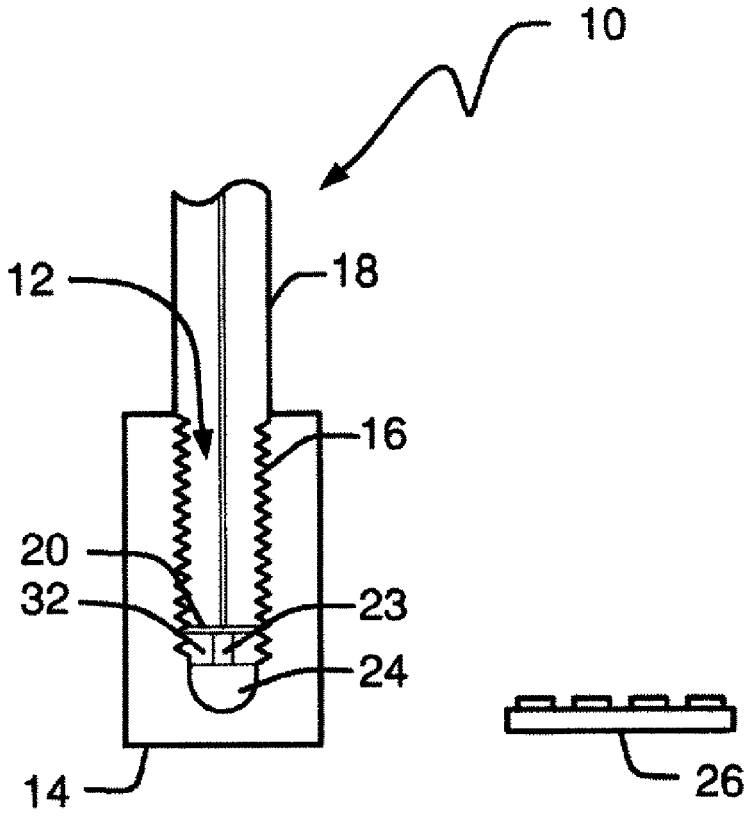
FIG. 1 is a longitudinal sectional view of a typical disposable high-pressure pump of the prior art.

FIG. 1 depicts a single use, disposable high-pressure pump 10 of the prior art. Blind bore 12 is formed in pressure vessel 14. Blind bore 12 is internally threaded as at 16 to receive capillary tubing 18. Flow regulator 20 performs the function its name expresses. A solid plug having a porous center 23 is positioned in closely spaced relation to flow regulator 20 and provides a closure means for cavity 24 which contains a homogenous charge. In the alternative, means 26 may be provided to pattern the charge for sequential action.

The material may be patterned (e.g. using photoreaction polymer-based explosives/propellants (such as PBX) to enable programmable pressure delivery or a train of actuators for sequential actuation either to maintain a desired pressure over time or actuate over time as part of a process activity.

The filter is integral to the operation of the pump because clean, particulate-free fluid is required in intended applications such as high pressure chromatographic systems.

Methods for actuating the phase change material include thermal, electrical, mechanical impact or an electromechanical hybrid such as piezoelectric. The pressure generated may also be used as an energy reservoir of compressed gas or liquid which is subsequently expanded into a turbine, a piezochamber, or other means for converting compressed fluid into electrical power. The compressed liquid or gaseous fluid energy storage may also have utility in delivering pneumatic, mechanical, or hydraulic power for process actuation.

Figure 2:
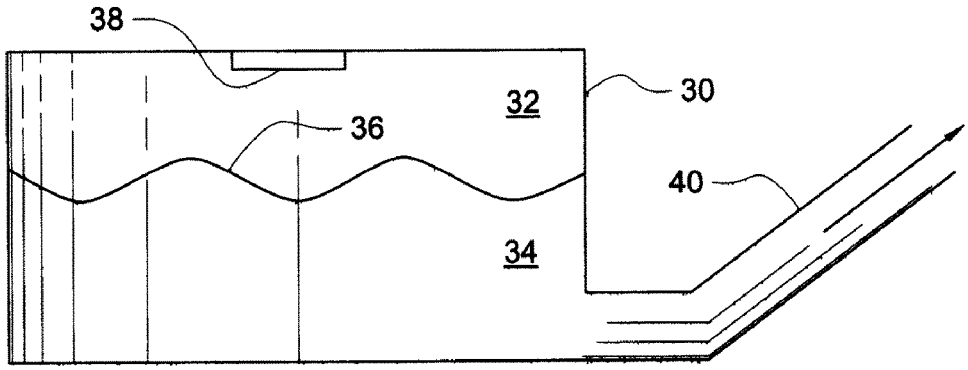
FIG. 2 is a diagrammatic representation of compressed-air energy storage plant.

The basic principle behind all embodiments of the invention is explained in connection with FIG. 2. Fixed or constant volume container 30 houses a liquid/gas combination. The gas is denoted 32, the liquid is denoted 34, and the liquid/gas interface is denoted 36. A propellant 38 is secured to an interior surface of container 30 in the gas region thereof and a fluid discharge conduit 40 is in fluid communication with the interior of container 30 in the liquid region thereof. When propellant 38 is activated, an explosion results in gaseous fluid that rapidly expands inside container 30 and drives liquid 34 into conduit 40 through turbine 42 and conduit 40*a* and compresses gas 40*c* inside reservoir 48. A load, not depicted in FIG. 2, is connected to the distal end of fluid discharge conduit 40 so that the fluid does useful work.

Figure 3:
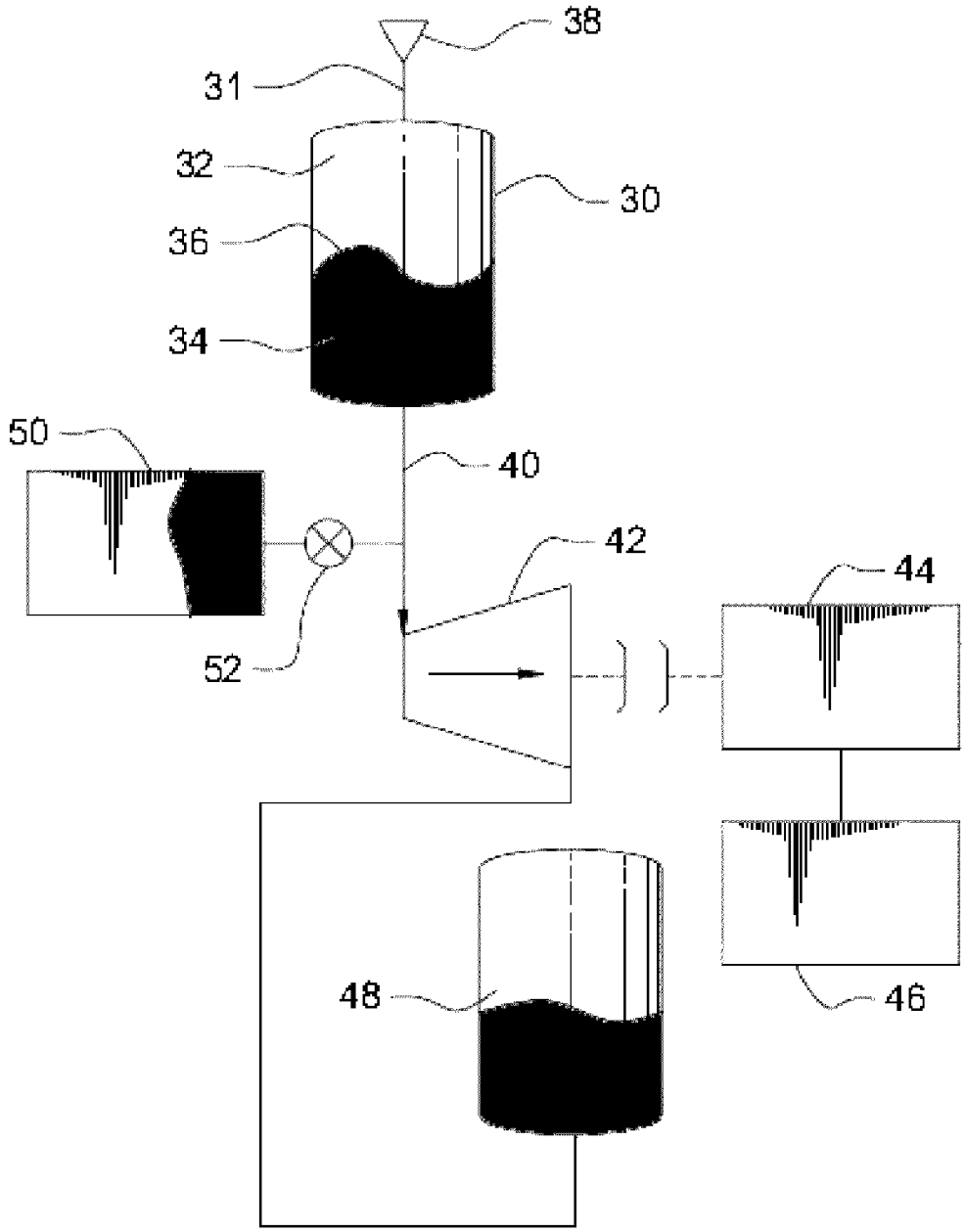
FIG. 3 is a diagrammatic representation of a combined mechanical, pneumatic, and hydraulic power plant.

A first embodiment of the invention, depicted in FIG. 3, includes a combined electrical, pneumatic, and hydraulic power plant. In this first embodiment, pressure provided by the explosive phase change is harnessed for electrical power. High pressure storage tank or reservoir 30 includes inlet 31 in fluid communication with phase change energy source 38. High pressure storage tank 32 is filled with a combination of gas 32 and liquid 34 that are separated from one another at liquid/gas interface 36. Gas 32 is in direct fluid communication with phase change energy source 38. Liquid 34 is in direct fluid communication with fluid discharge conduit 40 of high pressure storage tank 30. Conduit 40 is in fluid communication with turbine 42 and said turbine is connected in driving relation to generator 44. Transformer 46 connects the output of generator 44 to electrical loads in a well-known way.

Turbine 42 is also in fluid communication with reservoir 48. Reservoir 48 is a low-pressure reservoir because the pressure therein is less than the pressure in reservoir 30. The gas is denoted 40*c*, the liquid is denoted 40*b* and the liquid/gas interface is denoted 40*d*. When propellant 38 is activated and the liquid is moved from container 30 into reservoir 48 through conduit 40*a*, the gas 40*c* is compressed and is later expanded to move the liquid back to the initial position, which prepares the system for the next operational cycle. This pressure differential between the high and low pressure reservoirs may be harnessed on demand by any pressure-driven load.

A pneumatic or hydraulic circuit 50 is in fluid communication with fluid discharge conduit 40 so that loads other than turbine 42 may also be driven. Pneumatic or hydraulic circuit 50 is therefore positioned upstream of turbine 42 in valved fluid communication with fluid discharge conduit 40. The valve is denoted 52.

The combined electrical, pneumatic, and hydraulic power plant of FIG. 3 may be either single use (disposable) or rechargeable.

Figure 4A:
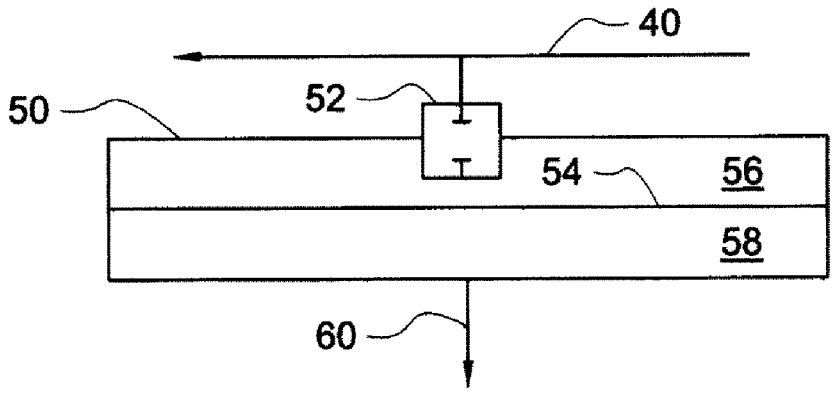
FIG. 4A is a diagrammatic representation of a pneumatic or hydraulic circuit when it is isolated from the system of FIG. 3 by a closed valve.
Figure 4B:
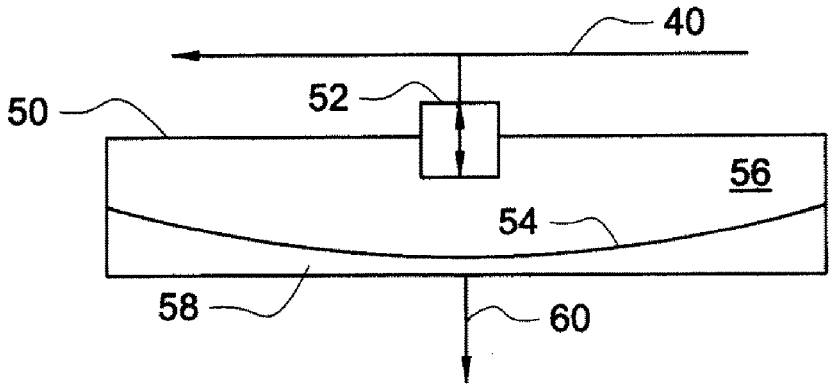
FIG. 4B is a diagrammatic representation of the pneumatic or hydraulic circuit of FIG. 4A when the valve is open.

Pneumatic or hydraulic circuit 50 is depicted in greater detail in FIGS. 4A and 4B. In FIG. 4A, valve 52 is closed. This has the effect of removing pneumatic or hydraulic circuit 50 from the apparatus of FIG. 3, i.e., all of the liquid or gaseous fluid flowing in fluid discharge conduit 40 is delivered to turbine 42 and no amount of said fluid is diverted into pneumatic or hydraulic circuit 50.

As depicted in FIG. 4A. pneumatic or hydraulic circuit 50 includes a closed, fixed volume container having diaphragm 54 that separates chamber 56 from chamber 58. Chambers 56 and 58 may contain either liquid fluid or gaseous fluid, depending upon the application. Chamber 58 is in valved communication with fluid discharge conduit 60. When chamber 58 is filled with liquid, circuit 50 is a hydraulic circuit and when chamber 58 is filled with gas, circuit 50 is a pneumatic circuit. When valve 52 is closed, diaphragm 54 remains in its FIG. 4A position of repose and no liquid or gas flows into fluid discharge conduit 60. Therefore, no mechanical or fluidic load in communication with said discharge conduit can do work.

When valve 52 is open, as depicted in FIG. 4B, liquid or gaseous fluid flowing in fluid discharge conduit 40 is diverted into pneumatic or hydraulic circuit 50. More particularly, said fluid flows into chamber 56, thereby displacing diaphragm 54 so that chamber 56 expands in volume and liquid or gas chamber 58 contracts in volume so that said liquid or gas is discharged therefrom. A hydraulic load is driven if chamber 58 is filled with hydraulic fluid and a pneumatic load is driven if chamber 58 is gas-filled.

Figure 5:
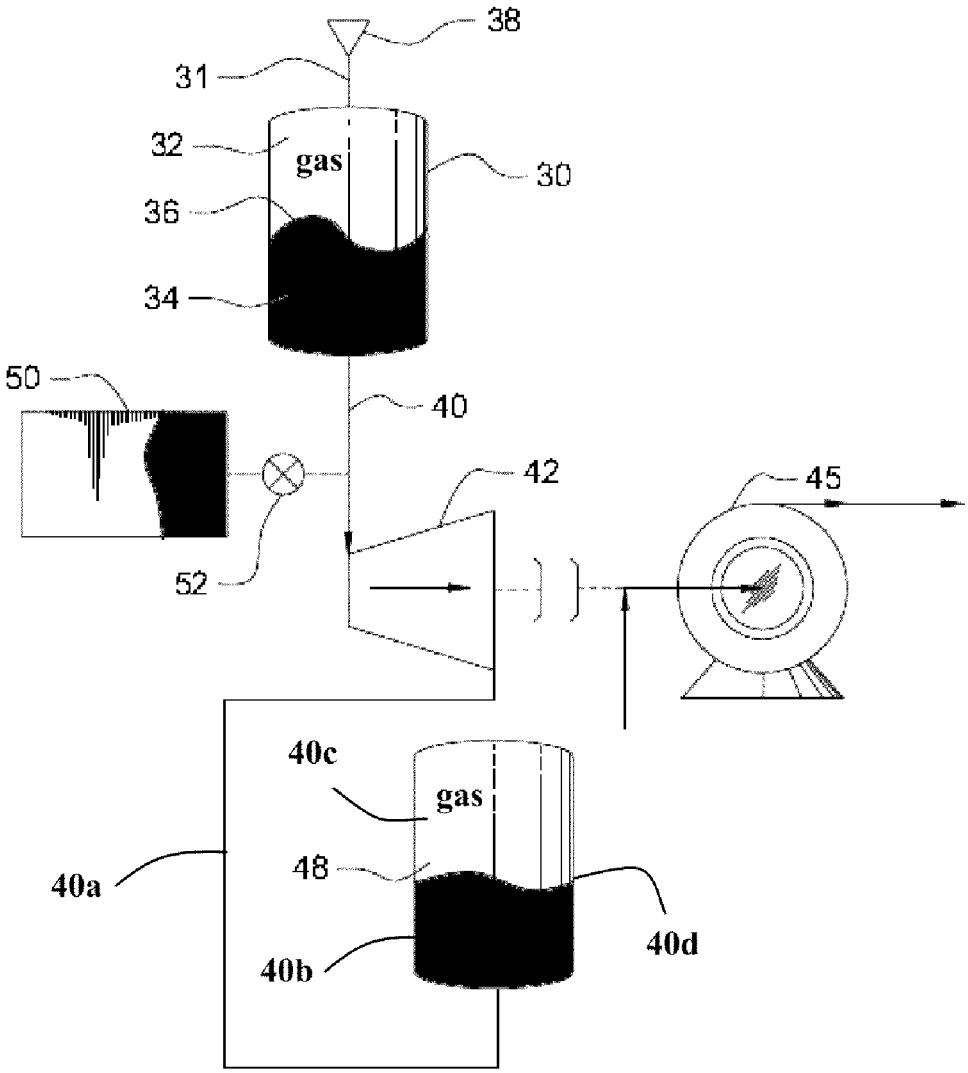
FIG. 5 is a diagrammatic view of a combined mechanical, pneumatic, and hydraulic power plant like that of FIG. 3, but with a pump replacing the turbine and generator of said FIG. 3.

A second embodiment is depicted in FIG. 5. The parts of this embodiment are the same as in the embodiment of FIG. 3 with the exception that pump 45 replaces generator 44 and there is no transformer 46. The combined mechanical, pneumatic, and hydraulic power plant of FIG. 5 may be either single use (disposable) or rechargeable.

Figure 6A:
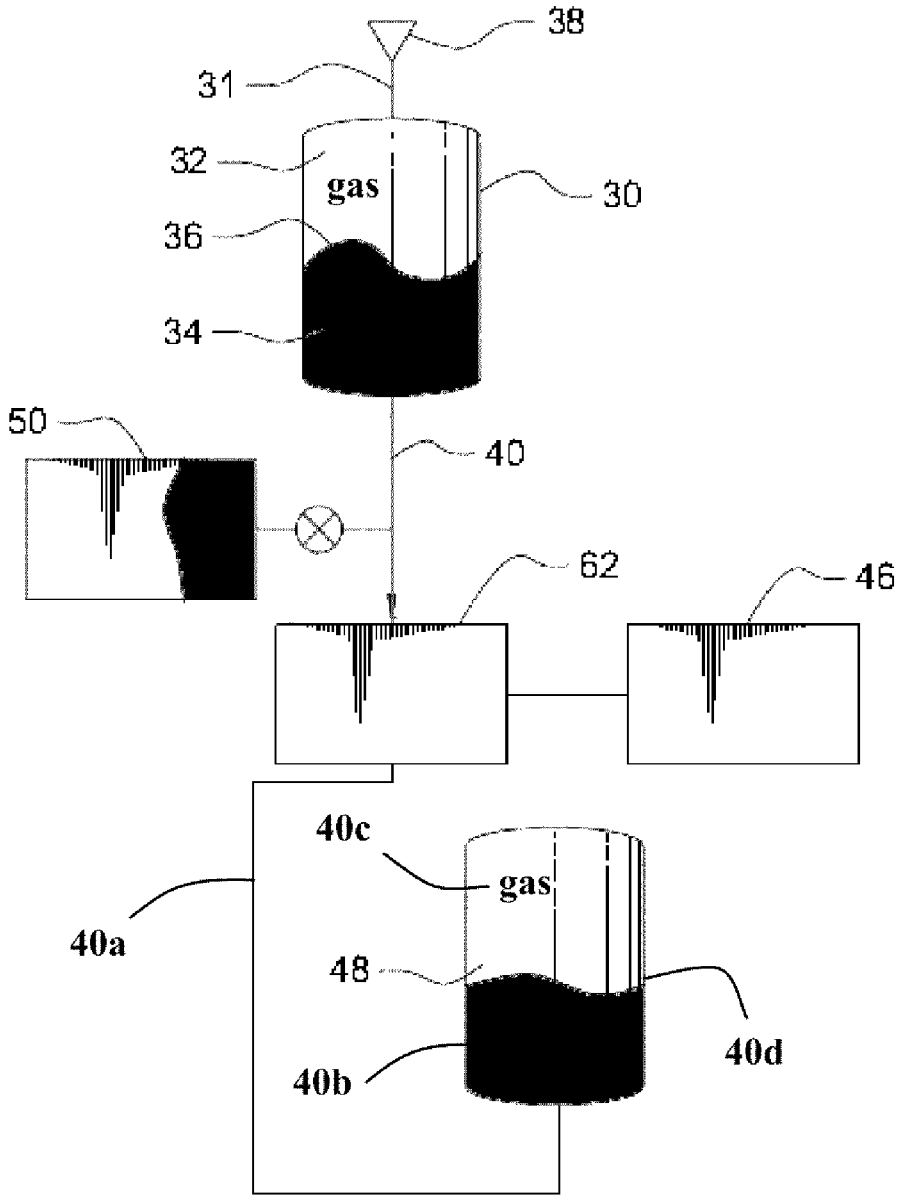
FIG. 6A is a diagrammatic representation of a combined mechanical, pneumatic, and hydraulic power plant like that of FIG. 3 but with a piezoelectric generator replacing the turbine and generator of FIG. 3.

A third embodiment is depicted in FIG. 6A. The parts of this embodiment are the same as the first with the exception that piezo-electric generator 62 replaces turbine 42 and generator 44.

Figure 6B:
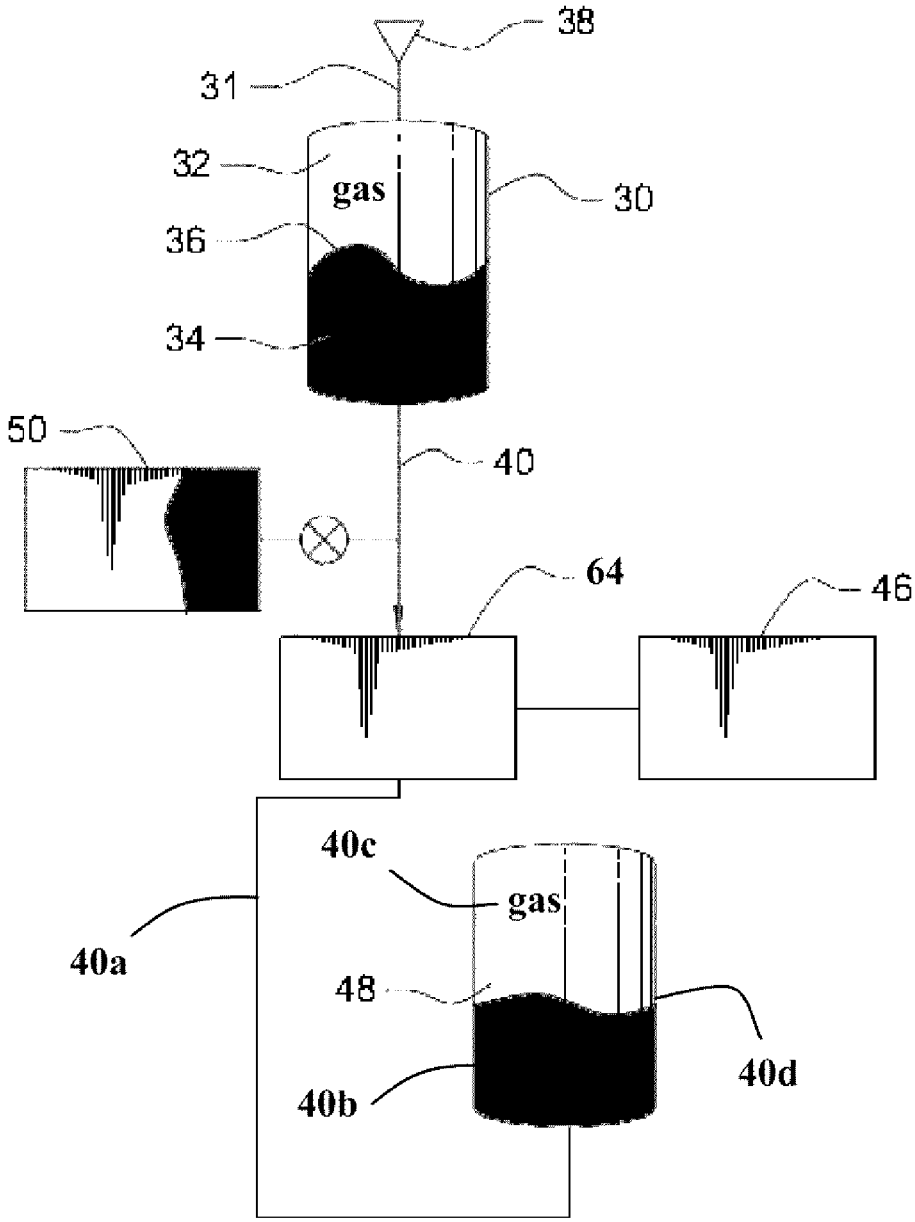
FIG. 6B is a diagrammatic representation of a combined mechanical, pneumatic, and hydraulic power plant like that of FIG. 3 but with an electromagnetic generator replacing the turbine and generator of FIG. 3.

A fourth embodiment is depicted in FIG. 6B. The parts of this embodiment are the same as the first with the exception that electromagnetic generator 64 replaces turbine 42 and generator 44. The combined electrical, pneumatic, and hydraulic power plant of FIGS. 6A and 6B may be either single use (disposable) or rechargeable.

Figure 7:
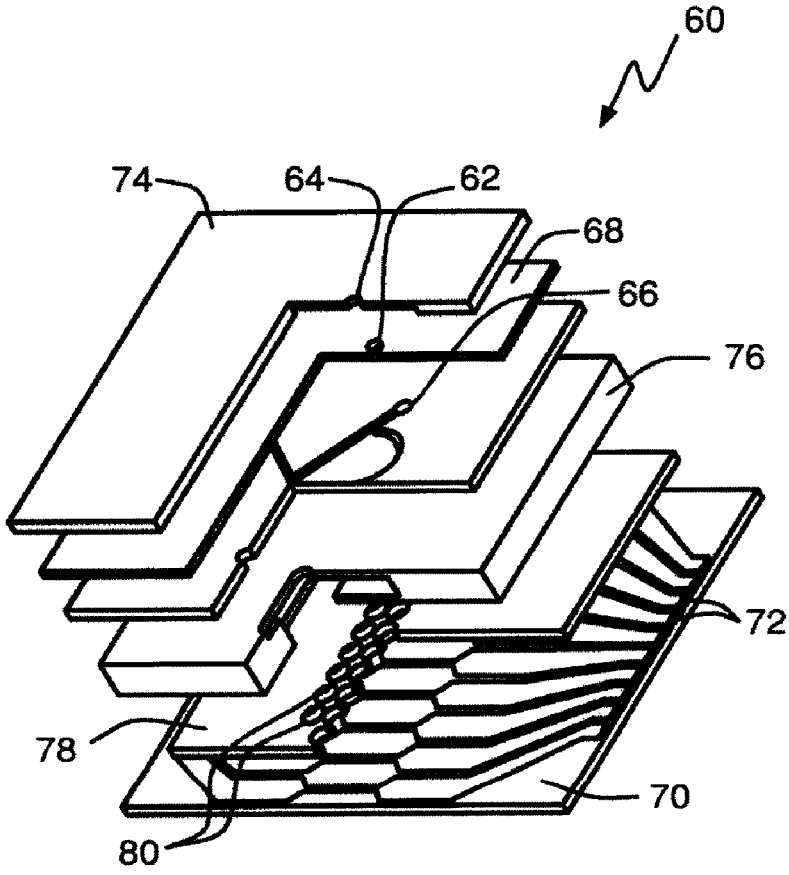
FIG. 7 is a perspective view of an AC flow, pressure on demand microbattery.

FIG. 7 depicts an AC flow, pressure on demand, microbattery 60. Current is generated by oscillation of magnetic core 62 in and out of coil 64. Fluidic oscillator 66 alternates the flow of fluid into each side of flexible diaphragm 68 and moves core 62 back and forth, said magnetic core 62 being mounted on said flexible diagram 68 as depicted. Each explosive charge is actuated by a substrate 70-mounted conductor 72 that also acts as an initiator. Microbattery 60 further includes cap layer 74, within which said coil 64 is formed, pressure cell 76, propellant mold and bond layer 78, and a plurality of propellant or explosive dots 80 formed of a phase change material.

In all embodiments, the device may be large in scale. However, the preferred and most likely to use embodiment includes the disclosed pumps and power plants in small-scale packages.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus for delivering power on demand, comprising:

a closed, constant volume container having a hollow interior;

a diaphragm positioned within said hollow interior that divides said hollow interior into a gaseous fluid chamber adapted to contain a gaseous fluid and a liquid fluid chamber adapted to contain a liquid fluid;

a propellant mounted to said container within said gaseous fluid chamber; and a fluid discharge conduit in fluid communication with said liquid fluid chamber;

whereby explosive detonation of said propellant causes an abrupt expansion of gaseous fluid in said gaseous fluid chamber and an abrupt displacement of said diaphragm so that said liquid fluid is abruptly driven from said liquid fluid chamber into said fluid discharge conduit;

whereby work is performed by a fluidic load in communication with said fluid discharge conduit;

whereby energy required to drive said fluidic load is delivered on demand and in the absence of a requirement to bring a source of fluid under pressure to the fluidic load.

* * * * *